US011933541B2

(12) United States Patent
Xu

(10) Patent No.: US 11,933,541 B2
(45) Date of Patent: Mar. 19, 2024

(54) CRYOGENIC AIR SEPARATION UNIT WITH ARGON CONDENSER VAPOR RECYCLE

(71) Applicant: Zhengrong Xu, East Amherst, NY (US)

(72) Inventor: Zhengrong Xu, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 274 days.

(21) Appl. No.: 17/399,713

(22) Filed: Aug. 11, 2021

(65) Prior Publication Data

US 2023/0050296 A1 Feb. 16, 2023

(51) Int. Cl.
*F25J 3/04* (2006.01)

(52) U.S. Cl.
CPC ..... *F25J 3/04678* (2013.01); *F25J 3/04412* (2013.01); *F25J 2200/06* (2013.01);
(Continued)

(58) Field of Classification Search
CPC .. F25J 3/04678; F25J 3/04412; F25J 2200/06; F25J 2200/72; F25J 2215/42; F25J 2215/50; F25J 2215/58; F25J 2245/58; F25J 2200/20; F25J 3/0426; F25J 2205/90; F25J 2210/42; F25J 2235/52; F25J 2235/58; F25J 2240/40; F25J 3/04048; F25J 3/04284;
(Continued)

(56) References Cited

U.S. PATENT DOCUMENTS 4,715,873 A * 12/1987 Auvil ..... F25J 3/04212 62/646
4,790,866 A 12/1988 Rathbone
(Continued)

FOREIGN PATENT DOCUMENTS

JP S61276680 A * 12/1986
WO WO 2022/058043 A1 3/2022

OTHER PUBLICATIONS

Anonymous Ed—Darl Kuhn; "An Integrated Heat Pump Cycle for Enhanced Argon Recovery"; ip.com, ip.com Inc., West Henrietta, NY, US, Sep. 12, 2003 (Sep. 12, 2003); XP013012743; ISSN: 1533-0001; p. 1, Paragraph 3.
(Continued)

*Primary Examiner* — John F Pettitt, III
*Assistant Examiner* — Ibrahim A. Michael Adeniji
(74) *Attorney, Agent, or Firm* — Robert J. Hampsch

(57) ABSTRACT

A system and method for producing two or more nitrogen product streams and a crude argon stream from a nitrogen and argon producing air separation unit is provided. The disclosed embodiments of the cryogenic-based nitrogen and argon producing air separation units and associated air separation cycles include the means for directing a first portion of a boil-off stream from an argon condenser of the air separation unit to a waste expansion refrigeration circuit and concurrently recycling a second portion of the boil-off stream from the argon condenser to the main air compression system of the air separation unit to be mixed or blended with the incoming feed air. Optionally, a third portion of the boil-off stream from the argon condenser may be further compressed in a cold compressor and returned to the lower pressure column.

18 Claims, 3 Drawing Sheets

(52) U.S. Cl.
CPC ..... *F25J 2200/72* (2013.01); *F25J 2215/42* (2013.01); *F25J 2215/50* (2013.01); *F25J 2215/58* (2013.01); *F25J 2245/58* (2013.01)

(58) Field of Classification Search
CPC .. F25J 3/04672; F25J 2210/04; F25J 2245/02; F25J 2245/42; F25J 2245/50; F25J 3/04303; F25J 3/04321; F25J 3/04363; F25J 2240/20; F25J 2240/22; F25J 2245/90
See application file for complete search history.

(56) References Cited

U.S. PATENT DOCUMENTS 4,848,996 A * 7/1989 Thorogood ..... F25J 3/0443 62/652
4,883,519 A * 11/1989 Agrawa ..... F25J 3/04284 62/652
5,701,763 A * 12/1997 Howard ..... B01D 53/04 95/41
10,816,263 B2 10/2020 Prosser et al.
2002/0029587 A1* 3/2002 Pompl ..... F25J 3/04672 62/649
2004/0244417 A1* 12/2004 Alamorian ..... F25J 3/04321 62/652
2006/0272353 A1* 12/2006 Prasad ..... F25J 3/04727 62/646
2007/0204652 A1* 9/2007 Musicus ..... F25J 3/0423 62/643
2007/0289726 A1* 12/2007 Jibb ..... F25J 3/04284 165/165
2019/0293347 A1* 9/2019 Hirose ..... F25J 3/04321
2019/0331416 A1 10/2019 Prosser et al.
2019/0331418 A1* 10/2019 Prosser ..... F25J 3/04181
2020/0318898 A1* 10/2020 Hirose ..... F25J 3/04872
2021/0372698 A1* 12/2021 Xu ..... F25J 3/04284

OTHER PUBLICATIONS

Harry Cheung; "Moderate-pressure cryogenic air separation process"; Gas Separation & Purification, vol. 5, No. 1, Mar. 1, 1991 (Mar. 1, 1991); pp. 25-28; XP055609506; ISSN: 0950-4214, DOI: 10.1016/0950-4214(91)80045-7, Figure 1.

* cited by examiner

CRYOGENIC AIR SEPARATION UNIT WITH ARGON CONDENSER VAPOR RECYCLE

TECHNICAL FIELD

The present invention relates to a cryogenic air separation unit, and more particularly, to a system and method for enhancing argon recovery and oxygen recovery in an oxygen, argon and nitrogen producing air separation unit by recycling a portion of the argon condenser vapor.

BACKGROUND

Among the various cryogenic air separation cycles used in a nitrogen and argon producing air separation units, it is often beneficial to take a medium to high pressure gaseous nitrogen (GAN) stream as one of the key products in the product slate. However, the amount of the pressure GAN stream available to be taken as a product stream is often limited because the extraction of the GAN adversely impacts the recovery of other products, namely the argon recovery.

Prior art nitrogen and argon producing air separation units of the type disclosed in U.S. Pat. No. 10,816,263 greatly improve argon recovery through the use of a subcooled liquid oxygen stream from the sump of the lower pressure column as the condensing medium in the argon condenser rather than the conventional subcooled kettle stream taken from the bottom of the higher pressure column. By doing so, the pressures within the argon column arrangement are increased which in turn back-pressures the rest of the distillation column system. because the argon column arrangement is back-pressured, more argon column stages are required to produce the targeted crude argon stream, often in excess of 240 stages. These additional argon column stages represent additional capital costs of the argon superstaged column compared to conventional argon superstaged columns in many oxygen and argon producing air separation units.

What is needed, therefore is a lower cost, nitrogen and argon producing air separation unit and air separation cycle that reduces the operating pressures of the argon column arrangement and the capital costs associated with the argon superstaged column while also mitigating the penalties to the argon recovery when using the kettle stream from the higher pressure column as the condensing medium in the argon condenser and also taking a medium pressure gaseous nitrogen stream as part of the product slate.

SUMMARY OF THE INVENTION

The present invention may be characterized as a nitrogen and argon producing air separation unit configured to receive an incoming feed air stream and produce two or more nitrogen product streams from the lower pressure and higher pressure columns of a distillation column system as well as a crude argon stream extracted from an argon column arrangement system that includes an argon superstaged column having less than or equal to about 200 stages and an argon condenser. The nitrogen and argon producing air separation unit also includes a waste expansion refrigeration circuit as a means to provide supplemental refrigeration needed to produce liquid streams. Inventive aspects and features of the nitrogen and argon producing air separation unit and associated air separation cycle comprise directing a first portion of the boil-off stream from the argon condenser to the waste expansion refrigeration circuit and recycling a second portion of the boil-off stream from the argon condenser to the main air compression system and mixed or blended with the incoming feed air. Optionally, a third portion of the boil-off stream from the argon condenser may be returned to the lower pressure column. Preferably, the recycle flow of the boil-off stream from the argon condenser to the main air compression system is between about 5% and about 45% of the flow of the incoming feed air stream. Also the portion of the boil-off stream from the argon condenser that is directed to the waste expansion refrigeration circuit is used to control the oxygen content in the feed stream to the waste expander.

The present invention may also be characterized as a method for operating a nitrogen and argon producing air separation unit with recycle of the boil-off vapor, comprising the steps of: (a) directing a first portion of a boil-off stream from an argon condenser to a waste expansion refrigeration circuit of the air separation unit; (b) mixing/blending the first portion of the boil-off stream from the argon condenser with a liquid oxygen stream from a lower pressure column the air separation unit; (c) directing the mixed stream (i.e. the oxygen-rich feed stream) to the waste expansion refrigeration circuit; (d) recycling a second portion of the boil-off stream to a main air compression system of the air separation unit; and (e) mixing/blending the second portion of the boil-off stream from the argon condenser with the incoming feed air stream. Preferably, the argon superstaged column has less than about 200 stages of separation and the argon recovery from the air separation unit is 75% or more of the argon contained in the incoming feed air stream. As indicated above, the recycled second portion of the boil-off stream from the argon condenser to the main air compression system is preferably between about 5% and about 45% of the flow of the incoming feed air stream. The oxygen containing condensing medium is preferably a subcooled kettle liquid stream taken from the higher pressure column while the two or more nitrogen product streams preferably include a low pressure nitrogen product stream taken from the lower pressure column, a medium pressure gaseous nitrogen product stream taken from the higher pressure column, and an optional liquid nitrogen stream.

In some embodiments, referred to as a partial recycle embodiment, a third portion of the boil-off stream from the argon condenser may be returned to the lower pressure column. Still other embodiments may include an additional step of cold compressing part of the boil-off stream from the argon condenser to produce a further compressed boil-off stream. The further compressed boil-off stream is then divided into the first portion of the boil-off stream and the third portion of the boil-off stream. In such arrangements, the expander in the waste expansion refrigeration circuit may be operatively coupled to and drive the cold compressor either directly or through appropriate gearing.

By recycling the portion of the boil-off vapor stream from the argon condenser to the to the main air compression system, argon recoveries from the air separation unit in excess of 70%, and more preferably in excess of 75% are attainable with little or no additional power costs compared to the air separation unit of the type disclosed in U.S. Pat. No. 10,816,263. More importantly, the present system and method enable good recoveries of argon and nitrogen at a significant reduction in height and associated capital costs of the air separation unit compared to the air separation plant of the type disclosed in the above-identified United States patent by reducing the pressure of the argon column arrangement and limiting the argon superstaged column to less than 200 stages, and more preferably less than 180 stages. In addition, the present system and method are configured to use a portion of the subcooled kettle stream from the higher pressure column as the condensing medium in the argon condenser and also produce both a low pressure gaseous nitrogen product from the lower pressure column as well as a medium pressure gaseous nitrogen product from the higher pressure column.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Turning now to the Figures, there is shown simplified illustrations of a nitrogen and argon producing air separation unit. In a broad sense, each of the cryogenic-based, nitrogen and argon producing air separation units 10,11,12 includes a main feed air compression system, a waste expansion refrigeration circuit, a main heat exchanger, and a distillation column system, described in more detail below.

Figure 1:
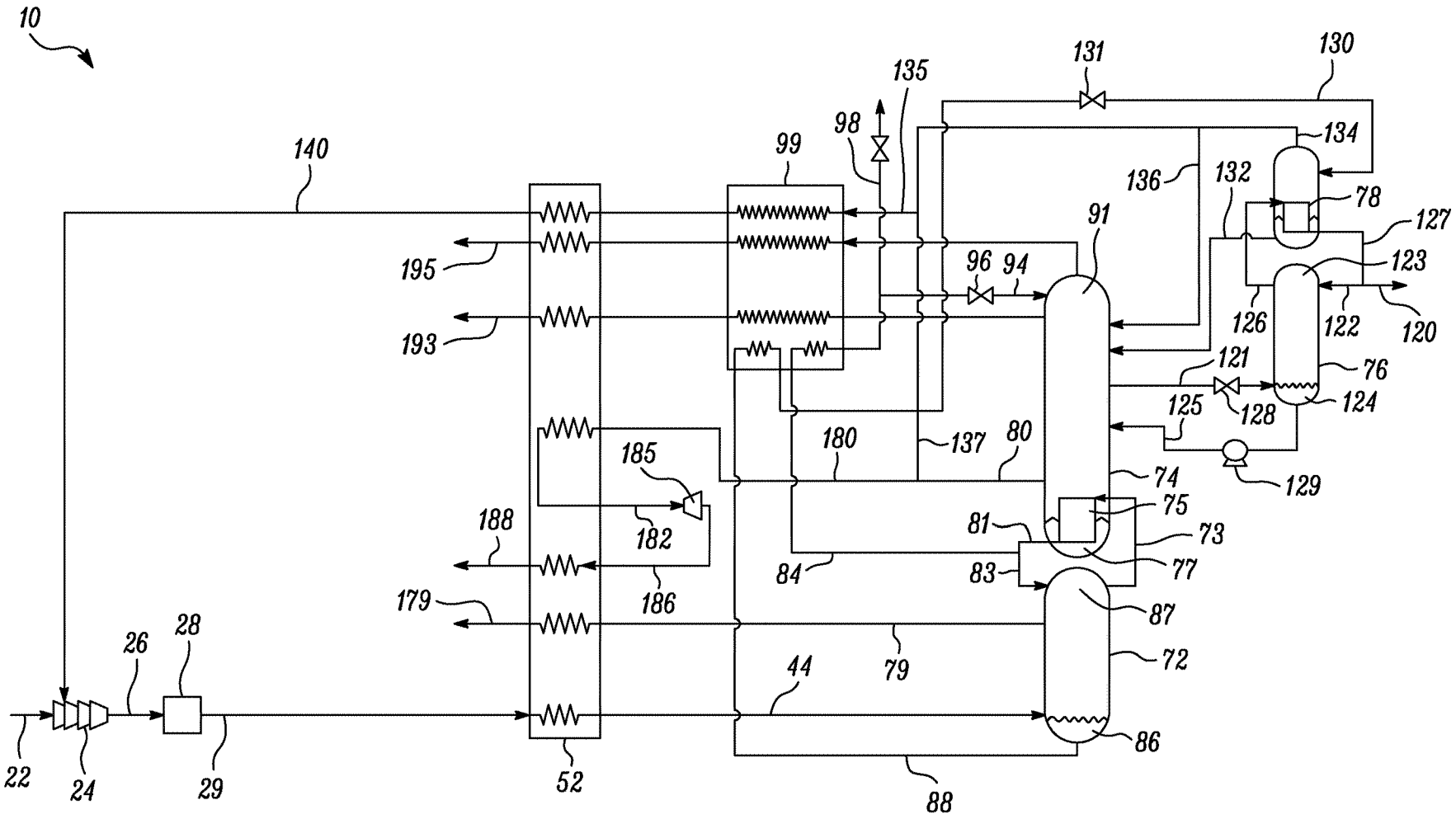
FIG. 1 is a partial schematic representation of a cryogenic air separation unit having an argon condenser vapor recycle in accordance with one embodiment of the present systems and methods.
Figure 2:
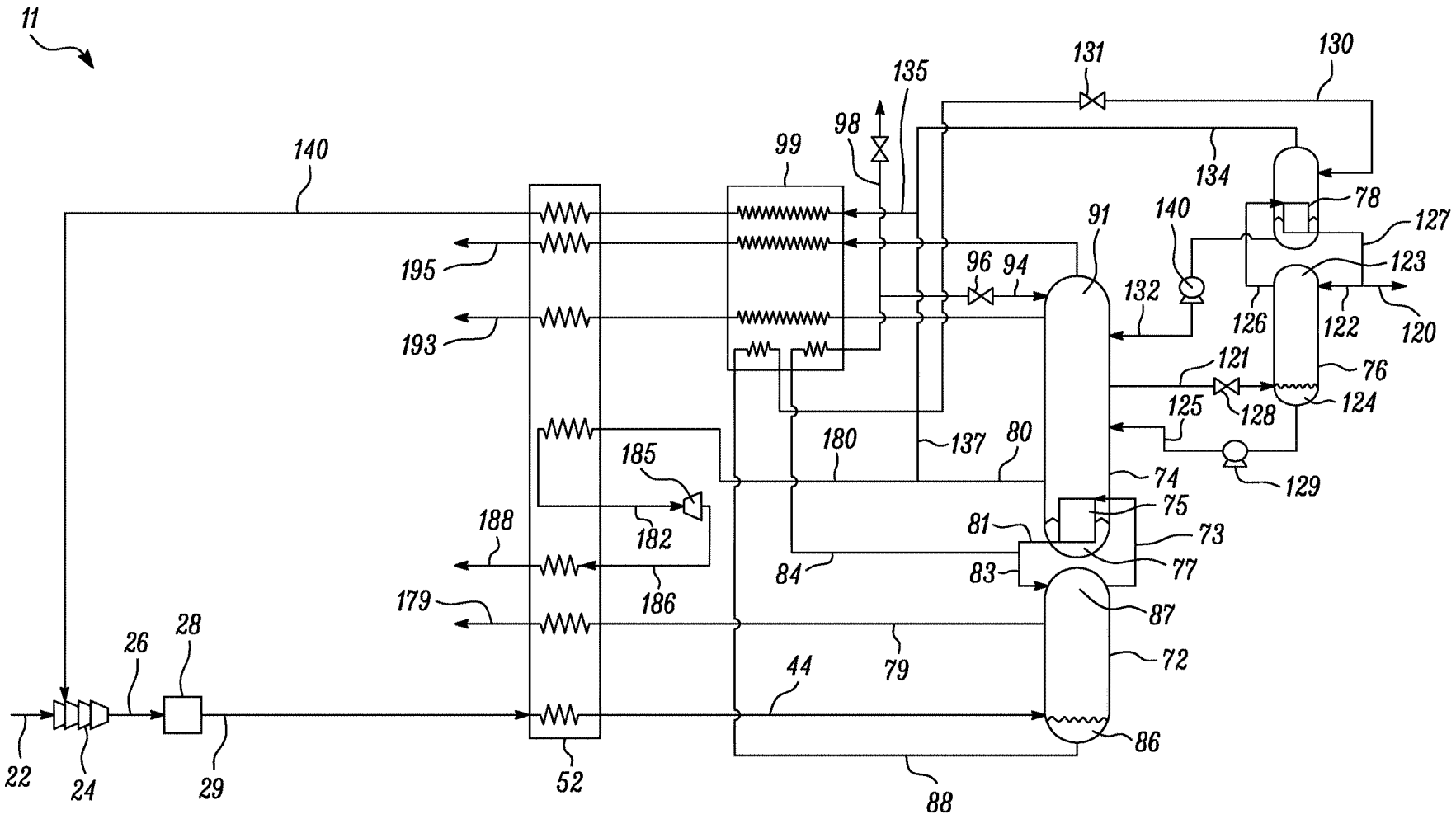
FIG. 2 is a schematic representation of another embodiment of a cryogenic air separation unit employing the present argon condenser vapor recycle features.
Figure 3:
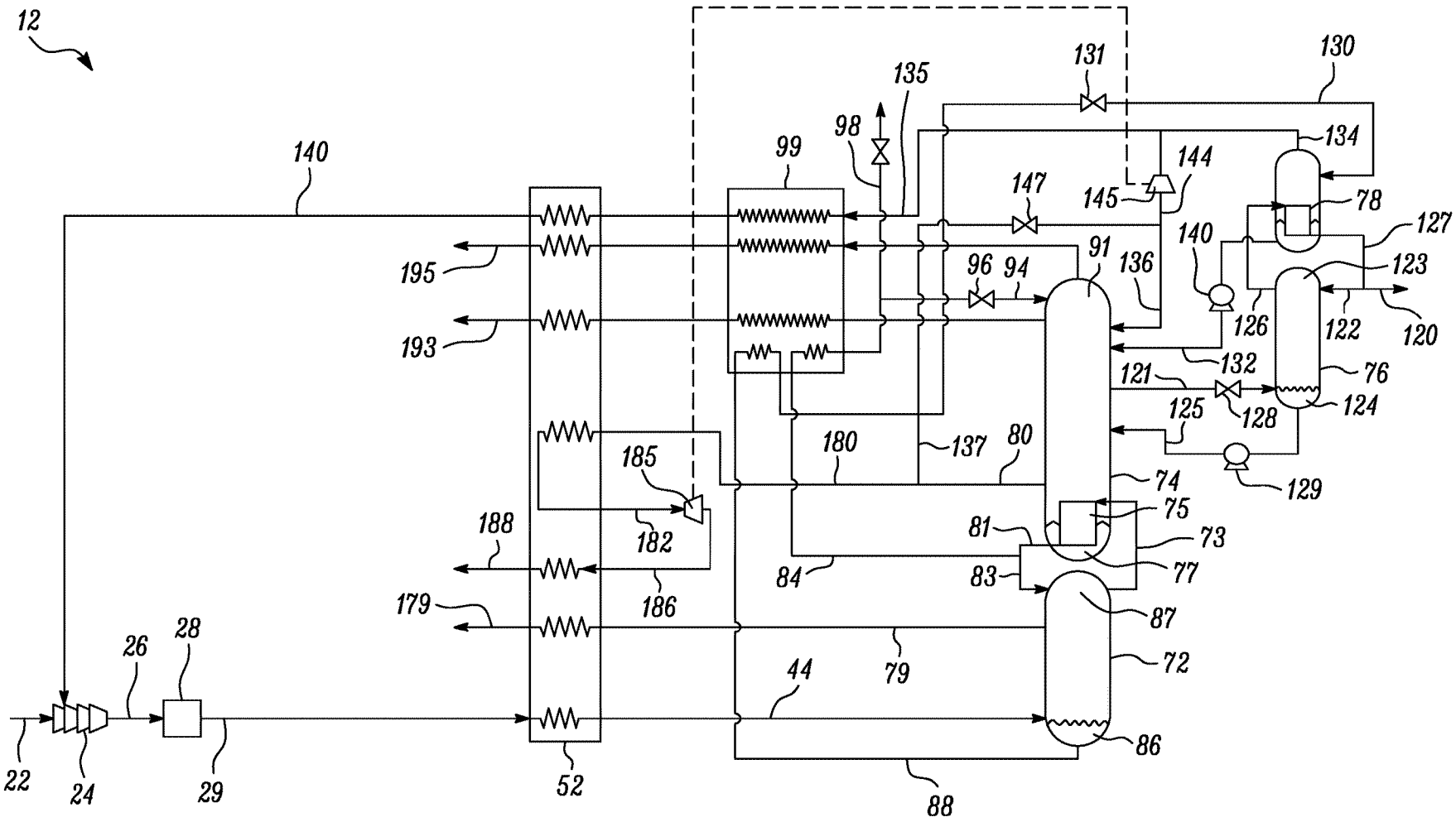
FIG. 3 is a schematic representation of yet another embodiment of a cryogenic air separation unit employing the present argon condenser vapor recycle features.

In the main feed air compression system shown in FIGS. 1, 2 and 3, the incoming feed air 22 is compressed in a multi-stage, intercooled main air compressor arrangement 24 to a pressure that can be between about 5 bar(a) and about 15 bar(a). This main air compressor arrangement 24 may include integrally geared compressor stages or a direct drive compressor stages. The compressed air stream exiting the main air compressor arrangement 24 is typically fed to an aftercooler with integral demister to remove the free moisture in the stream.

The cool, dry compressed air feed 26 is purified in a pre-purification unit 28 to remove high boiling contaminants from the cool, dry compressed air feed 26. The pre-purification unit 28, as is well known in the art, typically conducts an adsorption-based process that contains a plurality of layers of alumina and/or molecular sieve operating in accordance with a temperature and/or pressure swing adsorption cycle in which moisture and other impurities, such as carbon dioxide, water vapor and hydrocarbons, are adsorbed. While one of the beds is used for pre-purification of the cool, dry compressed air feed while the other bed is regenerated, preferably with a portion of the waste gases from the air separation unit. The two beds switch service periodically. Particulates may also be removed from the compressed, pre-purified feed air in a dust filter disposed downstream of the pre-purification unit 28 to produce the compressed, purified feed air stream 29.

As described in more detail below, the compressed, purified feed air stream 29 is separated into oxygen-rich, nitrogen-rich, and argon-rich fractions in a distillation column system having at least three columns including a higher pressure column 72, a lower pressure column 74, and an argon column arrangement, which may include the illustrated superstaged argon column 76, and one or more argon condensers 78. The argon column arrangement is preferably coupled to the lower pressure column 74 and arranged or configured with to produce a crude argon stream 120. The crude argon stream 120 may be further refined using various argon refining options, including but not limited to catalytic deoxo, liquid or gas phase argon adsorption purification, a high ratio column arrangement, or any combination thereof, may be included in or added to the integrated with the air separation unit, and more particularly integrated with other portions of the distillation column system.

In the illustrated embodiments, the compressed and purified feed air stream 29 is cooled in the main heat exchanger 52 to temperatures suitable for rectification and directed to the higher pressure column as fully cooled main air stream 44. The main heat exchanger 52 is preferably a brazed aluminum plate-fin type heat exchanger. Such heat exchangers are advantageous due to their compact design, high heat transfer rates and their ability to process multiple streams. They are manufactured as fully brazed and welded pressure vessels. For small air separation units, a heat exchanger comprising a single core may be sufficient whereas for larger air separation units handling higher flows, the main heat exchanger may be constructed from several cores connected in parallel or series.

In all contemplated embodiments, the aforementioned components of the feed air streams, namely oxygen, nitrogen, and argon are separated within the distillation column system using a well-known process of fractional distillation. In the present embodiments, the higher pressure column 72 typically operates at a pressure in the range from between about 5.0 bar(a) and about 15.0 bar(a) whereas the lower pressure column 74 typically operates at pressures between about 2.0 bar(a) and about 3.5 bar(a). As discussed in more detail below, the argon column 76 may operate at pressures generally independent of the lower pressure column 74, and preferably at lower pressures such as between about 1.1 bar(a) and 1.7 bar(a). Stream 121 taken from the intermediate location of the lower pressure column is preferably expanded in valve 128 to reduce the pressure suitable for rectification of the stream in the argon superstaged column. Likewise, the pressure of liquid stream 125 returned from the bottom of the argon superstaged column 76 to the lower pressure column 74 is raised via pump 129 to pressures necessary to introduce the oxygen-rich stream back into the lower pressure column 74.

The higher pressure column 72 and the lower pressure column 74 are preferably linked in a heat transfer relationship such that a nitrogen-rich vapor column overhead, extracted from the top of higher pressure column 72 as a stream 73, is condensed within a condenser-reboiler 75 located in the base of lower pressure column 74 against boiling an oxygen-rich liquid column bottoms 77. The boiling of oxygen-rich liquid column bottoms 77 initiates the formation of an ascending vapor phase within lower pressure column 74. The condensate from the condenser-reboiler 75 is a liquid nitrogen containing stream 81 that is that divided into reflux stream 83 and clean shelf nitrogen stream 84. Reflux stream 83 is returned to or released into the higher pressure column 72 to initiate the formation of descending liquid phases in such higher pressure column. A portion of the clean shelf nitrogen stream 84 is directed as reflux to the lower pressure column 74 to initiate the formation of descending liquid phases therein and a second gaseous nitrogen stream 71 is also taken from the upper section of the higher pressure column 72. The second gaseous nitrogen product stream 71 is then pumped in pump 171 and the resulting pumped gaseous nitrogen stream 79 is warmed in heat exchanger 52 to produce the medium pressure gaseous nitrogen product stream 179.

In the illustrated embodiments, the fully cooled main air stream 44 is introduced into the higher pressure column 72. In such embodiments, the fully cooled main air stream 44 is a medium pressure air stream at a pressure of between about 5 bar(a) and about 15 bar(a) that is discharged from the main heat exchanger 52 at or near the cold-end temperature. Within the higher pressure column 72, there is a mass transfer occurring between an ascending vapor phase with a descending liquid phase that is initiated by reflux stream 83 to produce a crude liquid oxygen column bottoms 86, also known as kettle liquid and the nitrogen-rich column overhead 87. A plurality of mass transfer contacting elements are used to facilitate the mass transfer between the ascending vapor and descending liquid in the higher pressure column 72.

Lower pressure column 74 is also provided with a plurality of mass transfer contacting elements such as structured packing or trays. As stated previously, the distillation process produces an oxygen-rich liquid column bottoms 77 and a nitrogen-rich vapor column overhead 91 that is extracted as a low pressure nitrogen product stream 95. If necessary, the low pressure nitrogen product stream may be further compressed in a nitrogen product compressor to the pressures desired by the customer, typically around 150 psia. An oxygen-rich gaseous stream 80 is extracted from a lower section of the lower pressure column 74. A portion of the recycle vapor stream 137 from the argon condenser may be mixed with the oxygen-rich stream 80 so as to control the oxygen content of the mixed stream 180 which is warmed in the main heat exchanger 52 and directed as a gaseous oxygen feed stream 182 to the waste expander 185. The gaseous oxygen feed stream 182 is expanded in waste expander 185 to produce oxygen-rich exhaust stream 186. Exhaust stream 186 is then warmed in the main heat exchanger 52 to provide the additional or supplemental refrigeration to the air separation unit and exits the main heat exchanger 52 as warmed oxygen-rich waste stream 188.

Additionally, a waste nitrogen stream 93 is often extracted from the lower pressure column 74 to control the purity of the low pressure nitrogen product stream 95. Both the low pressure nitrogen product stream 95 and nitrogen waste stream 93 are passed through subcooling unit 99 designed to subcool the kettle liquid stream 88 and subcool the clean shelf nitrogen stream 84. A portion of the subcooled clean shelf nitrogen stream 84 may optionally be taken as a liquid product stream 98 and the remaining portion, shown as reflux stream 94, is introduced into lower pressure column 74 after passing through expansion valve 96. After partial warming by passage through subcooling unit 99, the low pressure nitrogen product stream 95 and nitrogen waste stream 93 are fully warmed within main heat exchanger 52 to produce a warmed, low pressure nitrogen product stream 195 and a warmed nitrogen waste stream 193.

The argon superstaged column 76 receives an argon and oxygen containing vapor feed 121 from the lower pressure column 74 that is reduced in pressure via expansion valve 128 and down-flowing argon rich reflux 122 received from an argon condenser 78 situated above the superstaged argon column 76. The superstaged argon column 76 has less than 200 stages of separation, and more preferably less than 180 stages of separation, and serves to rectify the argon and oxygen containing vapor feed 121 by separating argon from the oxygen into an argon enriched overhead vapor 123 and an oxygen-rich liquid bottoms 124 that is returned to the lower pressure column via pump 129 as pumped oxygen-rich stream 125. All or a portion of resulting argon-rich vapor overhead 123 is preferably directed as argon-rich vapor stream 126 to the argon condenser 78 where it is condensed against an oxygen containing condensing medium 130. Most of the resulting condensate stream 127 taken from the argon condenser 78 is returned to the superstaged argon column 76 as argon reflux stream 122 while a smaller portion is taken as a crude liquid argon stream 120. Although not shown, the crude liquid argon stream 120 is typically directed to a high ratio argon column where it is rectified to form liquid argon bottoms from which a liquid argon product stream may be taken.

Within the argon condenser 78, the oxygen containing condensing medium 130 provides the cooling duty necessary to condense the argon-rich vapor stream 126 taken from the overhead 123 of the argon superstaged column 76. In the illustrated embodiments, a stream 88 of the crude liquid oxygen column bottoms 86 or kettle liquid is withdrawn from the higher pressure column 72, subcooled in subcooling unit 99 and expanded in an expansion valve 131 to the pressure at or near that of the argon condenser 78 as the oxygen containing condensing medium 130. As indicated above, a first large portion of the condensed argon stream 127 is returned to the argon column 76 as reflux stream 122 while a second smaller portion of the condensed argon stream 177 is taken as a crude argon stream 120. Any excess liquid from the condensing medium is returned to the lower pressure column 74 as liquid stream 132 while the boil-off vapor stream 134 from the argon condenser 78 is recycled.

As seen in the embodiment of FIG. 1, a first part of the boil-off vapor stream from the argon condenser 78 is directed to the waste expansion refrigeration circuit to be mixed with the gaseous oxygen stream 80 in an effort to control the oxygen content in the oxygen-rich feed stream 182 to the waste expander 185 in the waste expansion refrigeration circuit. A second part of the boil-off vapor stream from the argon condenser 78 is a recycle stream 135 that is warmed in subcooler 99 and main heat exchanger 52 and directed to the initial compression stage or intermediate compression stage of the main air compressor 24 as warm recycle stream 140. A third part of the boil-off stream from the argon condenser 78 may be returned to the lower pressure column 74 as stream 136.

By recycling the second part or second portion of the boil-off vapor stream from the argon condenser, the air separation unit may be configured for significantly increasing the argon recovery and moderately increasing the oxygen recovery while maintaining or increasing the production level of the medium or high pressure gaseous nitrogen product stream. Argon recoveries in excess of 70% and nitrogen recoveries in excess of 97% can be achieved with little or no additional power costs. In some cases, the power requirements are reduced while achieving increased argon production and maintaining the production levels of the medium to high pressure gaseous nitrogen product stream 179. Preferably, the flow of the second part or second portion of the boil-off stream from the argon condenser is between about 5.0% and about 12.0% of the flow of the incoming feed air stream.

FIG. 2 depicts a partial schematic diagrams of an alternate embodiment of the present system and method. Many of the features, components and streams associated with the oxygen, nitrogen, and argon producing air separation unit 11 shown in FIG. 2 are similar or identical to those described above with reference to the air separation unit 10 of FIG. 1 and for sake of brevity the description of such components and streams will not be repeated here.

The key differences between the nitrogen producing air separation unit 11 illustrated in FIG. 2 compared to the air separation unit 10 in the embodiment shown in FIG. 1 is the absence of the portion of the boil-off stream from the argon condenser 78 that is returned to the lower pressure column 74. In other words, the boil-off stream 134 from the argon condenser 78 is fully recycled to the waste expansion refrigeration circuit as stream 137 and the main air compression system as warm recycle stream 140.

FIG. 3 depicts yet another embodiment of the present system and method. Many of the features, components and streams associated with the oxygen, nitrogen, and argon producing air separation unit 12 shown in FIG. 3 are similar or identical to those described above with reference to the air separation unit 10 of FIG. 1. Again, for the sake of brevity the description of such identical or similar components and streams will not be repeated here.

The key differences between the nitrogen producing air separation unit 12 illustrated in FIG. 3 compared to the air separation unit 10 in the embodiment shown in FIG. 1 is the presence of a cold compressor 145 that is configured to further compress part of the boil off-stream 134 from the argon condenser 78. The further compressed boil-off stream 144 is then split with a portion being directed to the waste expansion refrigeration circuit as stream 137 and the remainder being returned to the lower pressure column 74 as stream 136. In some embodiments, cold compressor 145 may be a booster compressor operatively coupled to and driven by the waste expander 185 either directly or by appropriate gearing. In the embodiment shown in FIG. 3, the recycle flow of the boil-off stream to the main air compression system is increased compared to the embodiments in FIG. 1 to roughly 15% of the incoming feed air stream which improves the argon recovery in the air separation unit but at a slightly higher level of power consumption.

Examples

A number of computer simulations were run using cryogenic air separation unit operating models to characterize the advantages of recycling the argon condenser vapor stream. The results of the computer simulations are shown in Table 1. Note that the Baseline Case in Table 1 represents a conventional nitrogen and argon producing air separation unit of the type disclosed in U.S. Pat. No. 10,816,263. Case 1 represents a nitrogen and argon producing air separation unit in accordance with the embodiment depicted in FIG. 1 whereas Case 2 represents a nitrogen and argon producing air separation unit in accordance with the embodiment shown in FIG. 2 and Case 3 represents a nitrogen and argon producing air separation unit with the cold compressor in accordance with the embodiment shown in FIG. 3.

As seen in Table 1 below, by recycling a portion of the argon condenser boil-off vapor to the main air compressor, one can achieve decent argon recovery while maintaining the production of gaseous nitrogen product streams compared to a conventional nitrogen and argon producing air separation unit with significantly fewer stages of separation in the argon superstaged column. In other words, one can achieve decent argon recovery while maintaining the production of two gaseous nitrogen product streams at a significantly lower capital cost.

The Baseline Case shown in Table 1 does not recycle any of the argon condenser boil-off vapor whereas the computer simulated cases, namely Case 1 (i.e. partial recycle of argon condensing boil-off vapor to MAC), Case 2 (i.e. full recycle of argon condensing boil-off vapor to MAC), and Case 3 (i.e. cold compression of argon condensing boil-off vapor) recycle some or all of the argon condensing boil-off vapor to the main air compression system.

TABLE 1

| | | Baseline Case (>240 Stage Argon Column w/no Recycle) | Case 1 (FIG. 1) (<180 Stage Argon Column w/Part Recycle to WE & MAC | Case 2 (FIG. 2) (<180 Stage Argon Column w/Full Recycle to MAC | Case 3 (FIG. 3) (<180 Stage Argon Column w/Partial Recycle w/Cold-Compressor) |
|---|---|---|---|---|---|
| Argon Column Stages | # | 245 | 179 | 179 | 179 |
| Argon Condense Medium | — | Subcool LOX | Subcool Kettle (Stream 130) | Subcool Kettle (Stream 130) | Subcool Kettle (Stream 130) |
| Turbine-Based Refrigeration | — | Upper Column Turbine (UCT) | Waste Turbine Expansion (WE) | Waste Turbine Expansion (WE) | Waste Turbine Expansion (WE) |
| Argon Column Pressure | psia | 29.6 psia | 18.2 psia | 18.2 psia | 18.2 psia |
| Upper Column Pressure | psia | 32 psia | 29 psia | 45 psia | 40 psia |
| Incoming Feed Air (Stream 22) | Relative to Baseline | 100% | 102.5% | 100% | 100% |
| Recycle Vapor to MAC (Stream 140) | Relative to Feed Air | 0% | 8.0% | 40.0% | 14.5% |
| Argon Cond Vapor to UC (Stream 136) | Relative to Feed Air | 0% | 20.0% | 0% | 20.0% |
| Argon Cond Vapor to WE (Stream 137) | Relative to Feed Air | 0% | 2.6% | 0% | 0% |
| Low Pressure GAN Product (Stream 195) | Relative to Feed Air | 77.4% | 56.3% | 76.0% | 73.0% |
| Med Pressure GAN Product (Stream 179) | Relative to Feed Air | 0% | 20.0% | 0% | 5.0% |
| Crude Argon (Stream 170) | Relative to Feed Air | 0.9% | 0.72% | 0.83% | 0.80% |
| Crude Argon (Stream 170) | Relative to Baseline | 100% | 80.32% | 84.96% | 88.52% |
| Power Delta | Relative to Baseline | 100% | 94.5% | 101.3% | 98.6% |
| N2 Recovery | % | 99.98% | 97.50% | 99.94% | 99.96% |
| Argon Recovery | % | 96.9% | 76.00% | 88.2% | 85.30% |

In Case 1, a portion of the argon condensing boil-off vapor amounting to about 8.0% of the incoming air feed was recycled to the main air compression system while another portion of the argon condensing boil-off vapor amounting to about 2.60% of the incoming air feed was diverted to the waste expansion refrigeration circuit. The remaining boil-off vapor from the argon condenser amounting to about 20.0% of the incoming air feed was returned to the lower pressure column. The argon column in Case 1 has 66 fewer stages of separation than the Baseline Case and operates a pressure of only 18.2 psia yet produces a crude argon stream that was 80.32% of that achieved with the Baseline Case or 76% argon recovery. In addition, the system simulated in Case 1 produces both a low pressure gaseous nitrogen product and a medium pressure gaseous nitrogen product collectively totaling 76.3% of the incoming air feed and a nitrogen recovery of about 97.5%. Importantly, the power consumption associated with the simulated system of Case 1 is 5.5% lower than the Baseline Case.

In Case 2, referred to as the full recycle case, a portion of the argon condensing boil-off vapor amounting to about 40% of the incoming air feed was recycled to the main air compression system while no boil-off vapor from the argon condenser was diverted to the waste expansion refrigeration circuit or returned to the lower pressure column. Again, the argon column in Case 2 also has 66 fewer stages of separation than the Baseline Case and operates a pressure of only 18.2 psia yet produces a crude argon stream that was 88.52% of that achieved with the Baseline Case or 85.3% argon recovery. In addition, the system simulated in Case 2 produces both a low pressure gaseous nitrogen product and a medium pressure gaseous nitrogen product collectively totaling 78.0% of the incoming air feed and a nitrogen recovery of about 99.94%. The overall power consumption associated with the simulated system of Case 2 is 1.3% higher than the Baseline Case due to the increased power consumption of the main air compression system.

In Case 3, a portion of the argon condensing boil-off vapor amounting to about 14.5% of the incoming air feed was recycled to the main air compression system while none of the argon condensing boil-off vapor was diverted to the waste expansion refrigeration circuit. Boil-off vapor from the argon condenser amounting to about 20.0% of the incoming air feed was also returned to the lower pressure column. Once again, the argon column in Case 3 has 66 fewer stages of separation than the Baseline Case and operates a pressure of only 18.2 psia yet produces a crude argon stream that represents an argon recovery of 80.32% of that achieved with the Baseline Case. In addition, the system simulated in Case 1 produces both a low pressure gaseous nitrogen product and a medium pressure gaseous nitrogen product collectively totaling 76.3% of the incoming air feed and a nitrogen recovery of about 99.96%. The power consumption associated with Case 3 is about 1.4% lower than the Baseline Case.

Although the present invention has been discussed with reference to one or more preferred embodiments, as would occur to those skilled in the art that numerous changes and omissions can be made without departing from the spirit and scope of the present inventions as set forth in the appended claims. For example, alternate embodiments of the present system and method could employ other oxygen containing condensing mediums such as a portion of the high pressure liquid oxygen product stream or the pumped liquid oxygen stream, or even a synthetic kettle stream made up of a mixture of liquid oxygen and liquid nitrogen streams from within the air separation unit.

What is claimed is:

1. An argon and nitrogen producing air separation unit configured to receive an incoming feed air stream and produce a nitrogen product stream and an argon stream, the argon and nitrogen producing air separation unit having a main air compression and purification system, a main heat exchanger, a distillation column system having a higher pressure column and a lower pressure column linked in a heat transfer arrangement via a main condenser-reboiler, and an argon column arrangement comprising an argon column configured for receiving an argon-oxygen containing stream from the lower pressure column and an argon condenser configured for condensing an argon-rich vapor stream from the argon column against an oxygen containing condensing medium from the higher pressure column, the argon and nitrogen producing air separation unit characterized by:

a first portion of a boil-off stream from the argon condenser configured to be combined with an oxygen stream from the lower pressure column and expanded in a waste expansion turbine; and a second portion of the boil-off stream from the argon condenser is configured to be recycled and mixed with the incoming feed air stream.

2. The argon and nitrogen producing air separation unit of claim 1, wherein the first portion of a boil-off stream from the argon condenser is compressed in a cold compressor interposed between the argon condenser and the lower pressure column to produce a cold compressed boil-off stream.

3. The argon and nitrogen producing air separation unit of claim 2, wherein the cold compressed boil-off stream is divided into a first part configured to be combined with the oxygen stream from the lower pressure column and a second part that is returned to the lower pressure column.

4. The argon and nitrogen producing air separation unit of claim 3, wherein the waste expansion turbine is operatively coupled to and drives the cold compressor.

5. The argon and nitrogen producing air separation unit of claim 1, further comprising one or more subcoolers and wherein the oxygen containing condensing medium is a subcooled kettle liquid stream taken from the higher pressure column.

6. The argon and nitrogen producing air separation unit of claim 1, further comprising one or more subcoolers and wherein the oxygen containing condensing medium is a subcooled oxygen liquid stream taken from the lower pressure column.

7. The argon and nitrogen producing air separation unit of claim 1, further comprising one or more subcoolers and wherein the oxygen containing condensing medium is a synthetic kettle stream comprised of a subcooled oxygen liquid stream taken from the lower pressure column and a nitrogen stream from an external source of liquid nitrogen.

8. The argon and nitrogen producing air separation unit of claim 1, further comprising one or more subcoolers wherein the oxygen containing condensing medium is a synthetic kettle stream comprised of a subcooled oxygen liquid stream taken from the lower pressure column and a nitrogen stream from the lower pressure column or from the main condenser reboiler.

9. The argon and nitrogen producing air separation unit of claim 1, wherein the flow of the second portion of the boil-off stream is between about 12% and 25% of the flow of the incoming feed air stream.

10. The argon and nitrogen producing air separation unit of claim 5, wherein the argon column has less than 200 stages of separation and the argon recovery from the air separation unit is 75% or more of the argon contained in the incoming feed air stream.

11. A method for operating a nitrogen and argon producing air separation unit, the air separation unit configured to receive an incoming feed air stream and produce two or more nitrogen product streams, and a crude argon stream, the air separation unit having a main air compression system, a waste expansion refrigeration circuit, a main heat exchanger, and a distillation column system having a higher pressure column and a lower pressure column linked in a heat transfer arrangement via a main condenser-reboiler, an argon column configured for receiving an argon-oxygen containing stream from the lower pressure column and an argon condenser configured for condensing an argon-rich vapor stream from the argon column against an oxygen containing condensing medium, the method comprising the steps of:

(a) directing a first portion of a boil-off stream from an argon condenser to the waste expansion refrigeration circuit;

(b) mixing or blending the first portion of the boil-off stream from the argon condenser with a liquid oxygen stream from the lower pressure column to produce an oxygen-rich feed stream and control the oxygen content of the oxygen-rich feed stream feed stream;

(c) directing the oxygen-rich feed stream to the waste expansion refrigeration circuit;

(d) recycling a second portion of the boil-off stream from the argon condenser to the main air compression system;

(e) mixing or blending the second portion of the boil-off stream from the argon condenser with the incoming feed air stream; and wherein the argon column has less than about 200 stages of separation and the argon recovery from the air separation unit is 75% or more of the argon contained in the incoming feed air stream.

12. The method for operating a nitrogen and argon producing air separation unit of claim 11, further comprising the step of returning a third portion of the boil-off stream from an argon condenser to the lower pressure column.

13. The method for operating a nitrogen and argon producing air separation unit of claim 11, wherein the recycled second portion of the boil-off stream from the argon condenser is preferably between about 5.0% and about 12.0% of the flow of the incoming feed air stream.

14. The method for operating a nitrogen and argon producing air separation unit of claim 11, wherein the oxygen containing condensing medium is a subcooled kettle liquid stream taken from the higher pressure column.

15. The method for operating a nitrogen and argon producing air separation unit of claim 11, wherein the two or more nitrogen product streams further comprise a gaseous nitrogen product stream taken from the lower pressure column and another gaseous nitrogen product stream taken from the higher pressure column.

16. The method for operating a nitrogen and argon producing air separation unit of claim 12, further comprising the step of cold compressing part of the boil-off stream from the argon condenser in a cold compressor to produce a further compressed boil-off stream.

17. The method for operating a nitrogen and argon producing air separation unit of claim 16, further comprising the step of dividing the further compressed boil-off stream into the first portion of the boil-off stream and the third portion of the boil-off stream.

18. The method for operating a nitrogen and argon producing air separation unit of claim 16, wherein the cold compressor is operatively coupled to and driven by an expander in the waste expansion refrigeration circuit.

* * * * *